US007245728B2

(12) United States Patent
Killion et al.

(10) Patent No.: US 7,245,728 B2
(45) Date of Patent: Jul. 17, 2007

(54) MICROPHONE FOR HEARING AID AND COMMUNICATIONS APPLICATIONS HAVING SWITCHABLE POLAR AND FREQUENCY RESPONSE CHARACTERISTICS

(75) Inventors: Mead C Killion, Elk Grove Village, IL (US); Robert B Schulein, Evanston, IL (US); Elmer V Carlson, Glenview, IL (US); Viorel Drambarean, Skokie, IL (US)

(73) Assignee: Etymotic Research, Inc., Elk Grove Village, IL (US)

( * ) Notice: Subject to any disclaimer, the term of this patent is extended or adjusted under 35 U.S.C. 154(b) by 43 days.

(21) Appl. No.: 11/099,096

(22) Filed: Apr. 5, 2005

(65) Prior Publication Data

US 2005/0169490 A1 Aug. 4, 2005

Related U.S. Application Data

(63) Continuation of application No. 09/614,468, filed on Jul. 11, 2000, now Pat. No. 6,876,749.

(60) Provisional application No. 60/143,770, filed on Jul. 12, 1999.

(51) Int. Cl.
*H04R 3/00* (2006.01)

(52) U.S. Cl. ..... 381/122

(58) Field of Classification Search ..... 381/122–123, 381/312–313, 355–358, 377–378, 388, 322, 381/329, 92, 328; 710/14
See application file for complete search history.

(56) References Cited

U.S. PATENT DOCUMENTS

| | | | | | |
|---|---|---|---|---|---|
| 3,835,263 | A * | 9/1974 | Killion | 179/107 |
| 3,836,732 | A | 9/1974 | Johanson et al. | |
| 3,875,349 | A | 4/1975 | Ruegg | |
| 3,975,599 | A * | 8/1976 | Johanson | 381/313 |
| 4,051,330 | A * | 9/1977 | Cole | 381/313 |
| 4,142,072 | A * | 2/1979 | Berland | 381/313 |
| 5,341,433 | A | 8/1994 | Meyer et al. | |
| 5,524,056 | A * | 6/1996 | Killion et al. | 381/314 |
| 5,850,665 | A | 12/1998 | Bousset | |
| 5,933,510 | A | 8/1999 | Bryant et al. | |
| 6,101,258 | A | 8/2000 | Killion et al. | |
| 6,154,546 | A * | 11/2000 | Uvacek | 381/60 |
| 6,389,142 | B1 | 5/2002 | Hagen et al. | |
| 6,876,749 | B1 * | 4/2005 | Killion et al. | 381/122 |
| 2003/0156727 | A1 * | 8/2003 | Vonlanthen | 381/330 |

* cited by examiner

*Primary Examiner*—Vivian Chin
*Assistant Examiner*—Lun-See Lao
(74) *Attorney, Agent, or Firm*—McAndrews, Held & Malloy, Ltd.

(57) ABSTRACT

A microphone assembly generally for hearing aid and communications applications is disclosed. The microphone assembly operates in both directional and non-directional or omni-directional modes. The microphone assembly has front and rear sound inlet tubes, and an actuator switch that may be moved between a first position in which the rear tube is plugged, defining the omni-directional mode, and a second position in which the rear tube is unplugged, defining the directional mode. Circuitry senses the position of the actuator switch and selects a microphone output based on the position sensed.

21 Claims, 7 Drawing Sheets

MICROPHONE FOR HEARING AID AND COMMUNICATIONS APPLICATIONS HAVING SWITCHABLE POLAR AND FREQUENCY RESPONSE CHARACTERISTICS

CROSS-REFERENCE TO RELATED APPLICATIONS

This application is a continuation of U.S. application Ser. No. 09/614,468, which was filed Jul. 11, 2000, now U.S. Pat. No. 6,876,749, which makes reference to, and claims priority to, U.S. provisional application Ser. No. 60/143,770 filed Jul. 12, 1999.

INCORPORATED BY REFERENCE

The above-referenced U.S. provisional application Ser. No. 60/143,770 is hereby incorporated herein by reference in its entirety.

STATEMENT REGARDING FEDERALLY SPONSORED RESEARCH OR DEVELOPMENT

N/A

BACKGROUND OF THE INVENTION

Various types of hearing aids are known which have non-directional or omni-directional response characteristics; and, other types of hearing aids are known which have directional response characteristics. Still other prior art hearing aids are known which can be utilized either as directional hearing aids or as omni-directional hearing aids by suitable modification of the structure. However, such other prior art hearing aids, which can be used either as directional or omni-directional devices, have the marked disadvantage that when the aid is used as a omni-directional aid, it will have a given response characteristic relative to frequency, and when the aid is used as a directional aid, it will have an entirely different response characteristic relative to frequency. For example, curve or response line A of FIG. 3 in prior art U.S. Pat. No. 3,835,263 (Killion) shows a typical response of an omni-directional device wherein the lower frequency portion of the curve is relatively flat and then drops off at the higher frequencies. Curve B in FIG. 3 of the prior art Killion reference shows the frequency response characteristics of a directional device wherein the frequency response rises from a low value as a relatively straight line to a maximum level and then drops off at the higher frequencies.

Accordingly, it was an object of the prior art Killion reference to provide a microphone assembly particularly for use with hearing aids, which assembly can be operated either in a directional or a omni-directional mode, but which has essentially the same response characteristics relative to the frequency for sound arriving from the preferred direction whether it is operated in a directional or omni-directional mode.

The prior art Killion reference, however, did not provide flexibility in independently choosing the resulting frequency response of the microphone in the directional and omni-directional modes. In addition, the prior art Killion reference was acoustically complex and consequently difficult to implement.

It is therefore an object of the present invention to provide a less acoustically complex assembly having the same frequency response in the omni-directional and directional modes of operation, while also allowing flexibility in adjusting the frequency response of the microphone in the directional mode.

Other objects of the present invention will become apparent from the following detailed description of the invention when considered in conjunction with the accompanying drawings.

SUMMARY OF THE INVENTION

The present invention relates to a microphone assembly for hearing aid and other applications that is capable of operating in a directional mode and a non-directional or omni-directional mode. The microphone assembly has a microphone cartridge and front and rear inlet tubes that couple sound to each side of a diaphragm located in the microphone cartridge. An actuator switch of the assembly may be moved between a position in which the rear inlet tube is plugged, defining the omni-directional mode, and one in which the rear inlet tube is unplugged, defining the directional mode. Thus, a user of a hearing aid, for example, may select whether it is desirable, given the environmental conditions, to operate in the directional mode or the omni-directional mode.

Depending on the mode selected by the user, circuitry of the assembly selects a given output from the microphone. More specifically, the circuitry, which may be wholly or partially integrated into the microphone cartridge or an assembly housing, senses the position of the actuator switch, i.e., whether the rear inlet tube is plugged or unplugged, and selects an output that is desirable based on the operative mode. For example, if the rear inlet tube is unplugged, indicating the directional mode, the circuitry may select an equalized output from the microphone, or one with lower gain, or one including greater environmental noise reduction, for example. If, on the other hand, the rear inlet tube is plugged, indicating the omni-directional mode, the circuitry may select a non-equalized output from the microphone, or one with higher gain, or one including less environmental noise reduction, for example. In any case, the circuitry senses the mode selected and dictates the output from the microphone correspondingly.

Other aspects, advantages and novel features of the present invention will become apparent from the following detailed description of the invention when considered in conjunction with the accompanying drawings.

DETAILED DESCRIPTION OF THE INVENTION

Figure 1:
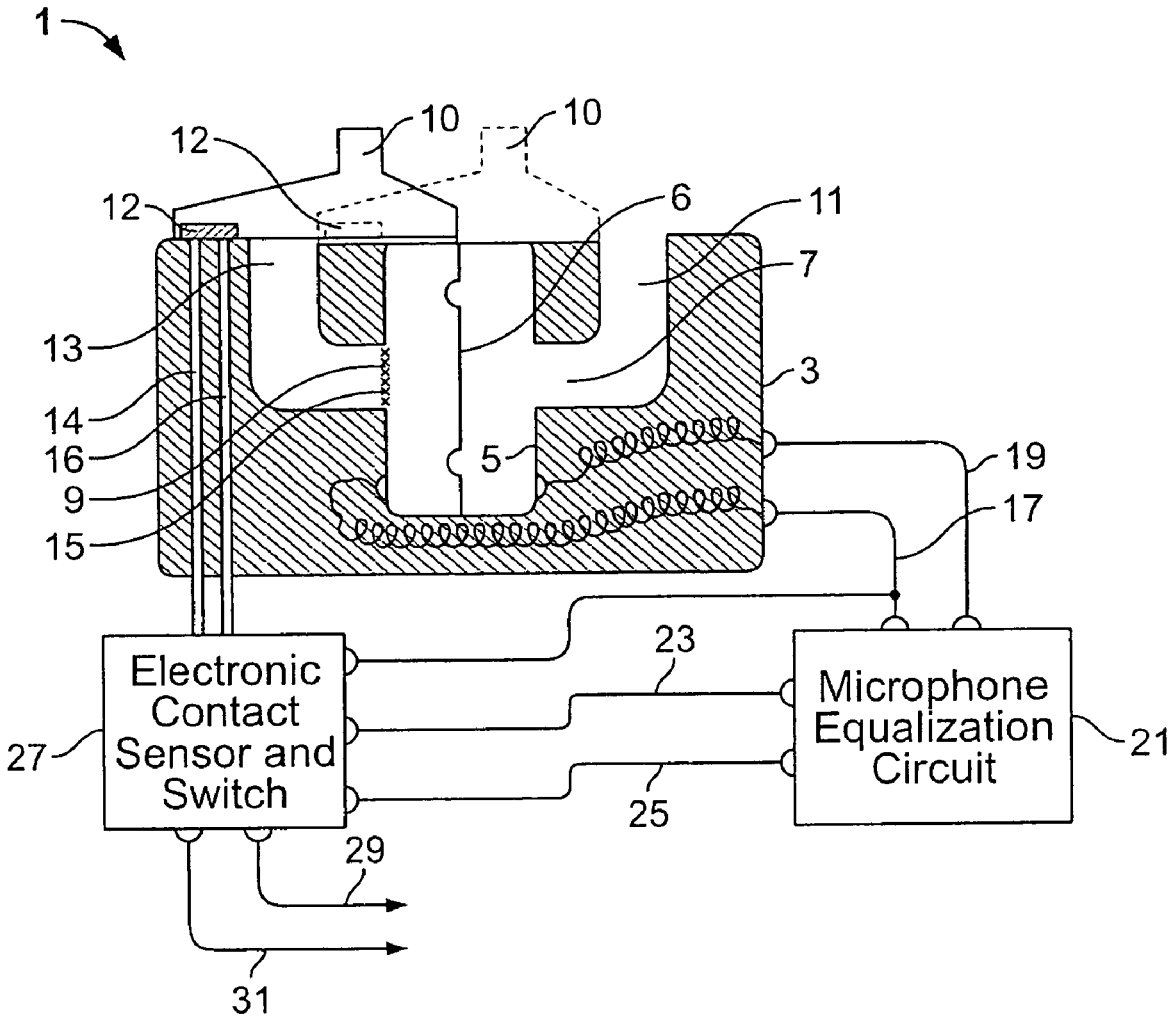
FIG. 1 illustrates one embodiment of a microphone assembly according to the present invention

FIG. 1 illustrates one embodiment of a microphone assembly according to the present invention. Microphone assembly 1 comprises a microphone housing 3 that encloses a microphone cartridge 5 therein. Microphone cartridge 5 has a diaphragm 6, a front sound inlet port or opening 7 and a rear sound inlet port or opening 9. Front sound inlet port 7 and rear sound inlet port 9 engage front sound inlet tube 11 and rear sound inlet tube 13, respectively, of microphone housing 3. An acoustic resistor 15 is located in rear sound inlet port 9. Acoustic resistor 15, however, may instead be located in rear sound inlet tube 13.

Microphone assembly 1 further comprises an actuator switch 10 that modifies the directional characteristics of the microphone assembly 1. Specifically, when the actuator switch 10 is in a directional position represented by the dotted lines in FIG. 1, the rear sound inlet tube 13 is uncovered and the microphone assembly 1 acts as a directional microphone. When the actuator switch 10 is moved to an omni-directional position represented by the solid lines in FIG. 1, the rear sound inlet tube 13 is plugged and the microphone assembly 1 acts as a non-directional or omni-directional microphone. We have found that an exact acoustic plug or seal of sound inlet tube 13 is not required, and that a 30-40K CGS acoustical ohm plug or seal is sufficient to achieve a desired omni-directional performance.

In addition, actuator switch 10 has an electrical contact 12 that, when actuator switch 10 is in omni-directional position, makes electrical contact between conductors 14 and 16. Electrical contact between the conductors 14 and 16 as such serves to indicate that the omni-directional position has been selected. Alternatively, the microphone assembly 1 may be configured such that electrical contact between the conductors 14 and 16 serves to indicate that the directional position has been selected.

Microphone cartridge 5 has electrical outputs 17 and 19 that represent the non-equalized outputs of the microphone cartridge 5. Electrical outputs 17 and 19 are electrically connected to a microphone equalization circuit 21. The microphone equalization circuit 21 provides an adjustable low frequency amplification for the outputs 17 and 19 of microphone cartridge 5. Microphone equalization circuit 21 has electrical outputs 23 and 25 that, along with electrical output 17 of the microphone cartridge 5, electrically connect to an electronic contact sensor and switch 27. Electronic contact sensor and switch 27, depending on the position of actuator switch 10, selects either output 17 of the microphone cartridge 5 or output 23 of microphone equalization circuit 21. Specifically, when the actuator switch 10 is in the directional position, no contact is made between conductors 14 and 16, and electronic contact sensor and switch 27 selects the output 23 from the microphone equalization circuit 21. As mentioned above, the microphone equalization circuit 21 increases the low frequency output of the microphone cartridge, which is desirable to obtain a more frequency balanced sound pick-up.

When the actuator switch 10 is in the omni-directional position, contact is made between conductors 14 and 16. Electronic contact sensor and switch 27 senses the contact between conductors 14 and 16 and consequently selects output 17 of microphone cartridge 5. In the omni-directional position as such, no equalization by microphone equalization circuit 21 is desirable due to the inherently flat frequency response of the microphone cartridge 5 when the rear sound inlet tube is sufficiently plugged.

In either the directional or non-directional mode, electronic contact sensor and switch 27 provides microphone outputs 29 and 31 to an input circuit, such as, for example, a hearing aid amplifier.

It should be understood that the electronic contact sensor and switch 27 and microphone equalization circuit 21 may be partially or wholly integral to the microphone housing 3 or microphone cartridge 5. In addition, the functionality of the electronic contact sensor and switch 27 and microphone equalization circuit 21 may be combined in a single circuit, such as a hybrid circuit, for example, having electrical outputs 17 and 19 and conductors 14 and 16, as well as microphone outputs 29 and 31, electrically connected thereto. Such a single circuit (not shown) may similarly be partially or wholly integral to the microphone housing 3 or microphone cartridge 5.

In another embodiment, the functionality of the electronic contact sensor and switch 27 and microphone equalization circuit 21 may be performed by hearing aid circuitry, such as, for example, hearing aid amplifier circuitry. Again, such circuitry may be partially or wholly integral to the microphone housing 3 or microphone cartridge 5.

While the embodiment of FIG. 1 shows the electronic contact and sensor switch 27 selecting an equalized or non-equalized output based on the mode (i.e., directional or non-directional) selected by the actuator switch 10, other types of outputs are contemplated and within the scope of the present invention. For example, the electronic contact and sensor switch 27 may alternatively (or additionally) adjust the gain based on the mode selected. More specifically, if the actuator switch 10 is in the directional position, such that both front and rear sound inlet tubes 11 and 13 are open and no contact is made between conductors 14 and 16 as discussed above, the electronic contact and sensor switch 27 may select a microphone output with a higher gain, for example. If, on the other hand, the actuator switch 10 is in the omni-directional position, such that the rear sound inlet is plugged and contact is made between conductors 14 and 16 as discussed above, the electronic contact and sensor switch 27 may select a microphone output having a lower gain or no gain, for example. In such a configuration, the microphone equalization circuit 21 may be replaced with gain circuitry (not shown), for example, or the electronic contact and sensor switch 27 may include its own circuitry for controlling gain, or completely separate gain circuit may be included.

As another example, the electronic contact and sensor switch 27 may alternatively (or additionally) electronically control or select environmental noise reduction based on the mode selected. More specifically, if the actuator switch 10 is in the directional position as discussed above, the electronic contact and sensor switch 27 may select more environmental noise reduction, for example. If, on the other hand, the actuator switch 10 is in the omni-directional position as discussed above, the electronic contact sensor and switch 27 may select less environmental noise reduction, for example. In such a configuration, the microphone equalization circuit 21 may be replaced with electronic noise reduction circuitry (not shown), for example, or the electronic contact and sensor switch 27 may include its own electronic noise reduction circuitry, or completely separate electronic noise reduction circuitry may be included.

Environmental noise reduction as such may comprise any type of electronic signal processing that reduces the amount of environmental noise heard by a user of a hearing aid.

In any case, the electronic and sensor switch 27 selects a microphone output (or in other words, an input to hearing aid or other circuitry) based on the mode selected by actuator switch 10. Again, regardless of the configuration or functionality of the circuitry used, such circuitry may be partially or wholly integrated into the microphone housing 3 or microphone cartridge 5.

Figure 2A:
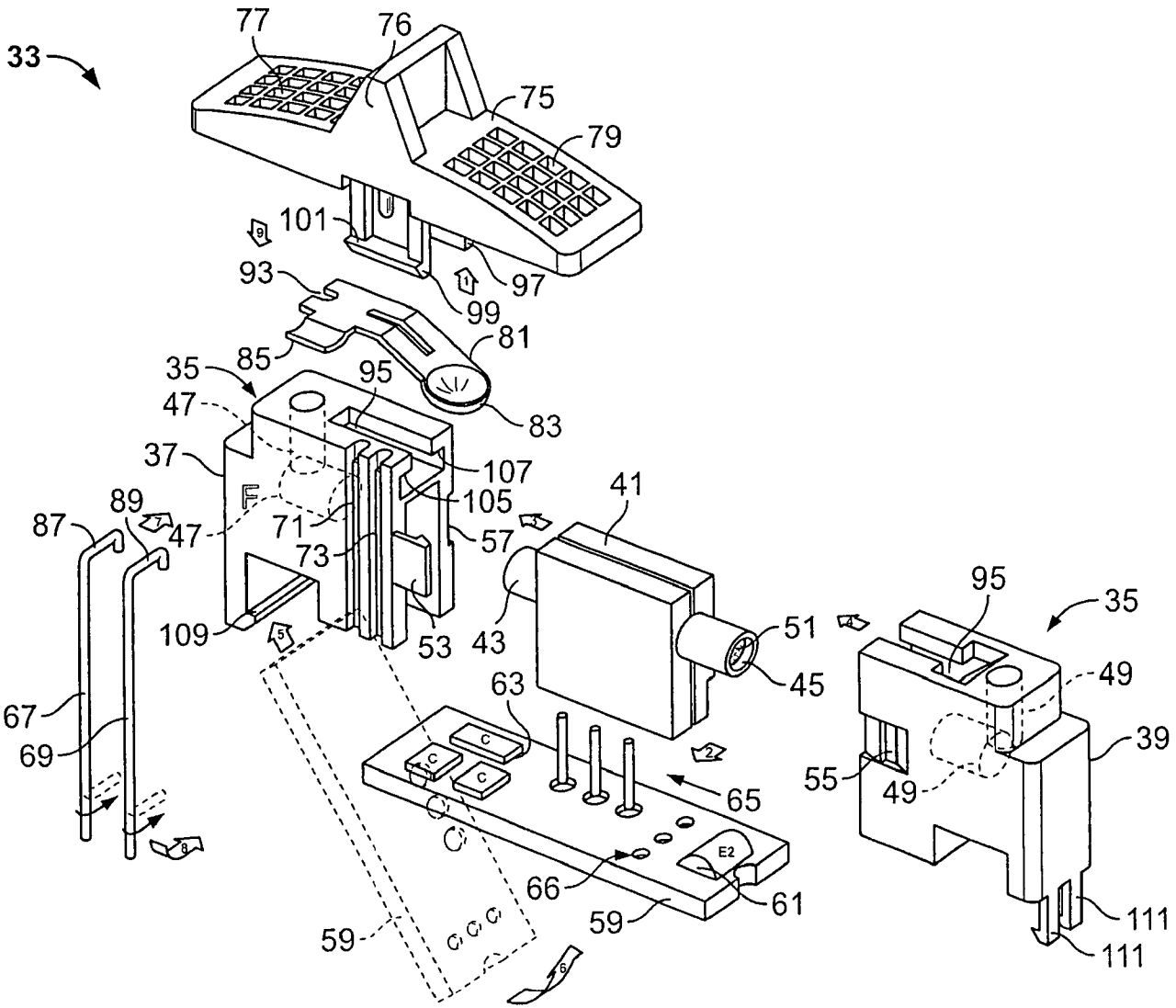
FIG. 2A illustrates an exploded view of one embodiment of the microphone assembly of FIG. 1

FIG. 2A illustrates an exploded view of one embodiment of the microphone assembly of FIG. 1 built in accordance with the present invention. Microphone assembly 33 comprises a microphone housing 35 having a front housing portion 37 and a rear housing portion 39. Microphone assembly 33 further comprises a microphone cartridge 41 that has a front sound inlet port 43 and a rear sound inlet port 45. Upon assembly, front sound inlet port 43 of the microphone cartridge 41 engages the front sound inlet tube 47 of the front housing portion 37, and rear sound inlet port 45 of the microphone cartridge 41 engages the rear sound inlet tube 49 of the rear housing portion 39. An acoustic resistor 51 is shown in FIG. 2A as being located in the rear sound inlet port 45 of the microphone cartridge 41. Front housing portion 37 has a tab 53 that, upon assembly, releasably engages a recess 55 located in the rear housing portion 39. Rear housing portion 39 likewise has a tab (now shown) that releasably engages a recess 57 located in the front housing portion 37. Such snap-fit assembly configuration acts to enclose the microphone cartridge 41 in the microphone housing 35, and releasably lock the front housing portion 37 and rear housing portion 39 together.

Microphone cartridge 41 is electrically connected to a circuit board 59 that includes a microphone equalization circuit 61 and an electronic contact sensor and switch 63 mounted on the circuit board 59. Electrical connections 65 (V+, output, ground) electrically connect the microphone cartridge 41 to the circuit board 59. Circuit board 59, and specifically electronic contact sensor and switch 63, is connected to conductors 67 and 69, similarly as discussed above with respect to conductors 14 and 16 of FIG. 1. Conductors 67 and 69 are mechanically mounted in grooves 71 and 73, respectively, located in the front housing portion 37.

Circuit board 59 is mounted to a bottom portion of the microphone housing 35. Specifically, front housing portion 37 includes a ledge 109 that receives an end of an undersurface of circuit board 59. Rear housing portion 39 includes releasable tabs 111 that receive an opposite end of the undersurface of circuit board 59. Circuit board 59, therefore, snap fits to the microphone housing 35. Circuit board 59 also includes microphone outputs 66 to an input circuit, such as, for example, a hearing aid amplifier.

Figure 2B:
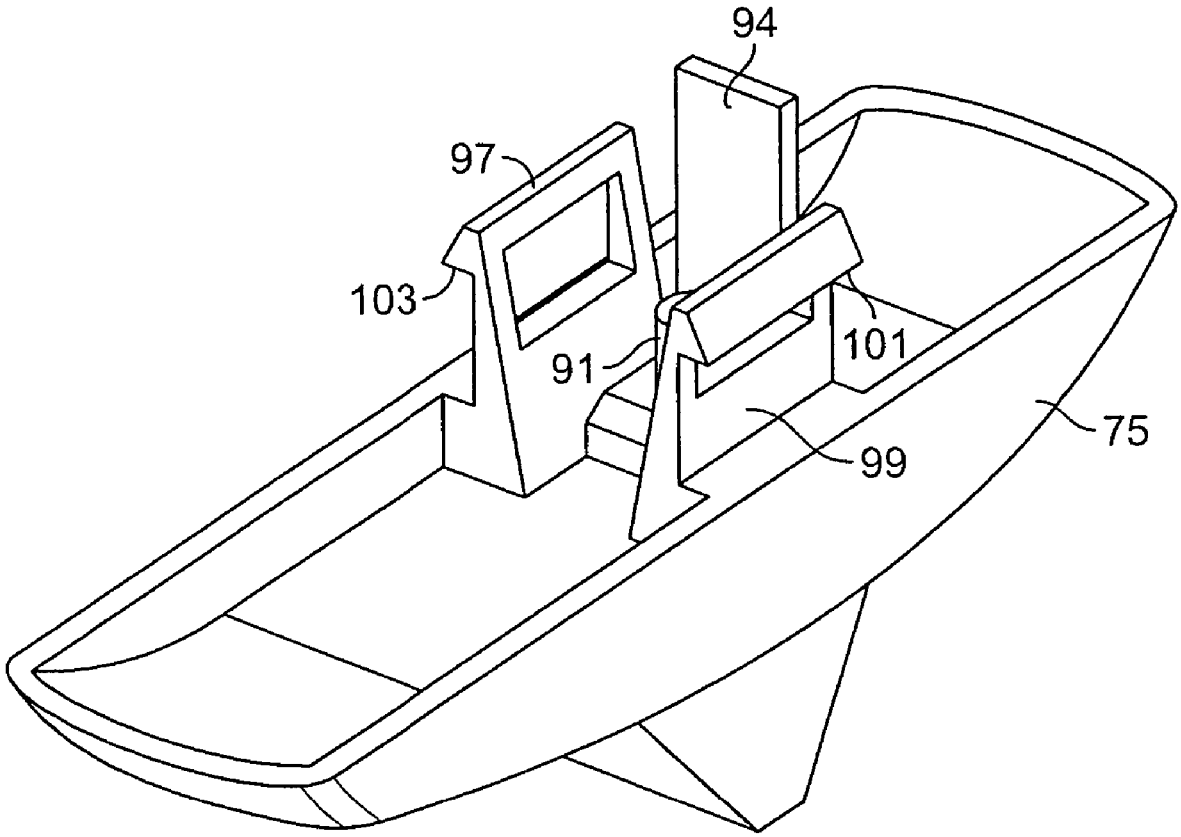
FIG. 2B illustrates another view of the actuator switch shown in FIG. 2A.

Microphone assembly 33 further comprises an actuator switch 75 that is mounted on the microphone housing 35. Two different views of actuator switch 75 are shown in FIGS. 2A and 2B. The actuator switch 75 has a front sound inlet protective screen 77 and a rear sound inlet protective screen 79 for acoustical coupling with the front sound inlet tube 47 and rear sound inlet tube 49, respectively, of the microphone housing 35. Actuator switch 75 further includes a raised portion 76 for sliding the actuator switch 75, and a member 81 mounted on an underside of the actuator switch 75. The member 81 has a portion 83 for plugging the rear sound inlet tube 49, and a conductive portion 85 for contacting surfaces 87 and 89 of conductors 67 and 69, respectively. An underside of actuator switch 75 includes a post 91 that engages a notch 93 of member 81, and a stop 94 that abuts an end of the member 81 having the notch 93. Such configuration aligns the member 81 in the proper position so that it can travel in, and be guided by, a channel 95 located in both front housing portion 37 and rear housing portion 39. Additionally, stop 94 prevents excessive motion in either direction of the member 81 within the channel 95.

As mentioned above, the actuator switch 75 is mounted on the microphone housing 35. Actuator switch 75 includes tabs 97 and 99 that, upon assembly, are pressed together and fit into channel 95. A surface 101 of tab 99 and a surface 103 of tab 97 engage surfaces 105 and 107, respectively, in the channel 95 of microphone housing 35.

Figure 3:
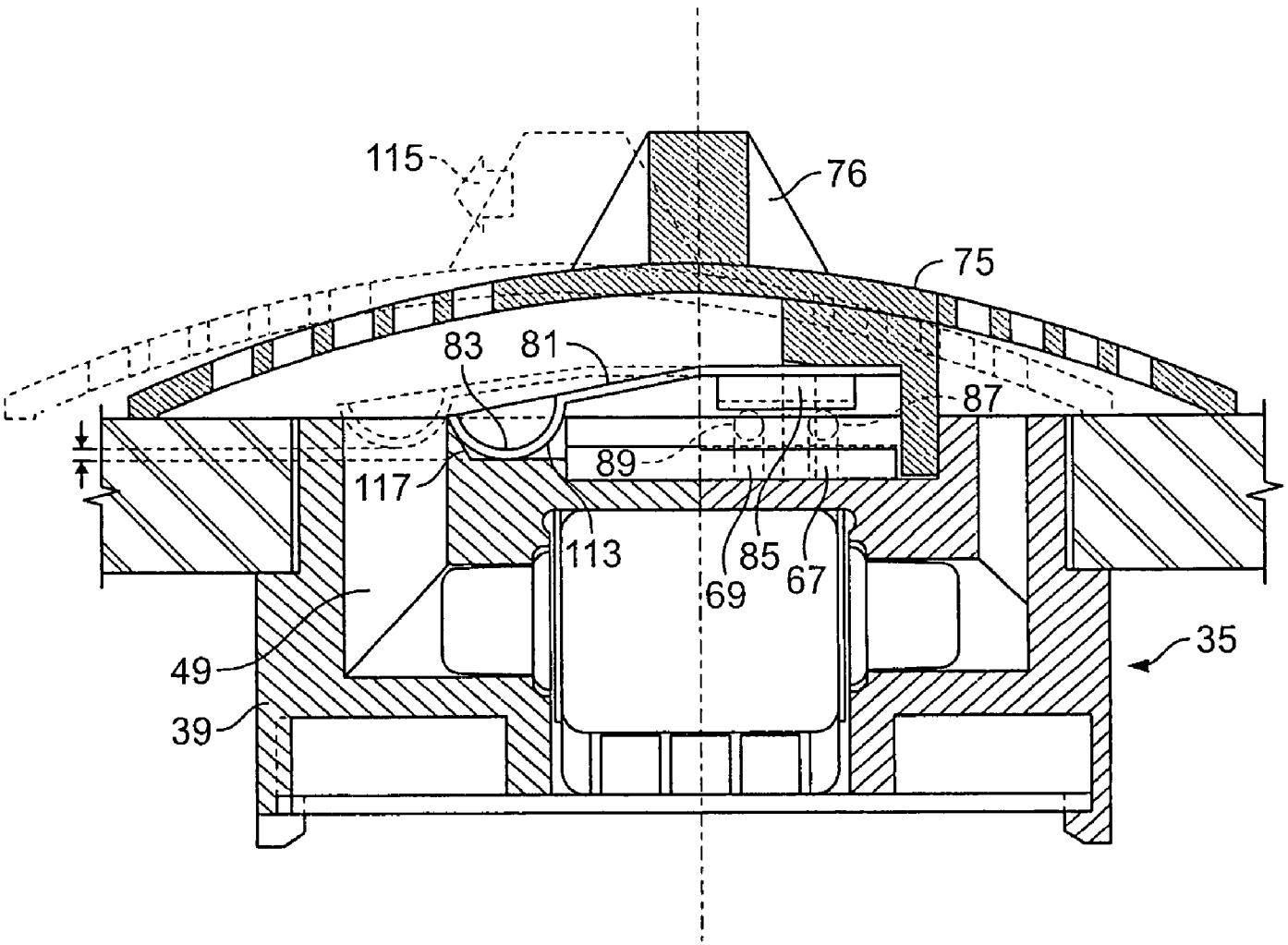
FIG. 3 illustrates a cross-sectional assembled view of the microphone assembly of FIG. 2A.

FIG. 3 illustrates a cross-sectional assembled view of the microphone assembly 33 of FIG. 2A. As can be seen, when the actuator switch 75 is in a directional position as indicated by the solid lines, plugging portion 83 of member 81 resides in a retaining pocket 113 located in the rear housing portion 39 of microphone housing 35. Also, in the directional position, conductive portion 85 of member 81 electrically contacts surfaces 87 and 89 of conductors 67 and 69, respectively, indicating that the directional position has been selected. To switch to the omni-directional position, a user pushes against raised member 76 of actuator 75 in a direction indicated by dotted arrow 115 until actuator switch 75 is in a omni-directional position as indicated by the dotted lines. As the actuator switch is moved, plugging portion 83 rides up incline 117 of retaining pocket 113 until it seats in the rear sound inlet tube 49. Conductive portion 85 of member 81 is likewise moved in the direction of dotted arrow 115 causing electrical contact between surfaces 87 and 89 of conductors 67 and 69 to be interrupted, indicating that the omni-directional position has been selected.

Figure 4:
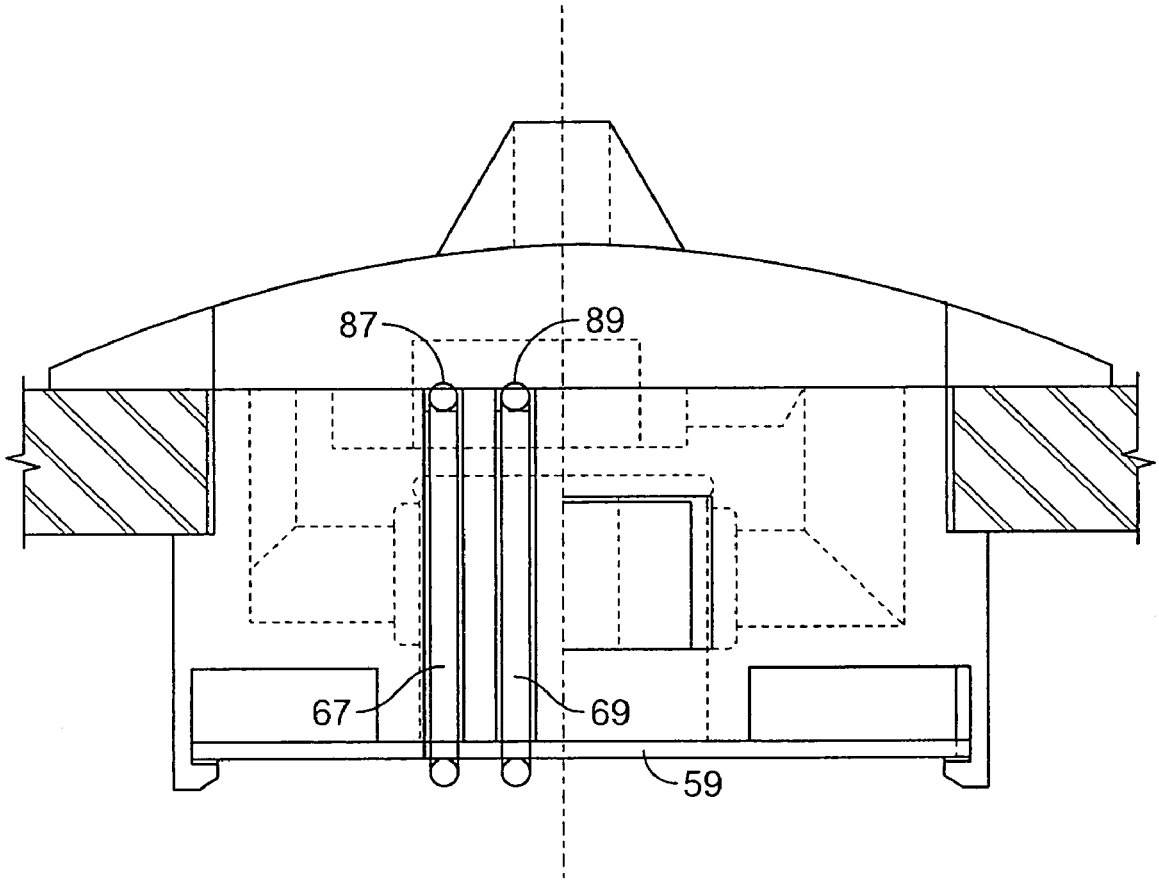
FIG. 4 is another assembled cross-sectional view of the microphone assembly of FIG. 2A.

FIG. 4 is another assembled cross-sectional view of the microphone assembly 33 of FIG. 2A. The view of FIG. 4 illustrates the electrical connection of conductors 67 and 69 to circuit board 59, as well as surfaces 87 and 89 that are electrically connected together via conductive portion 85 of member 81 (as shown in FIGS. 2A and 3).

Figure 5:
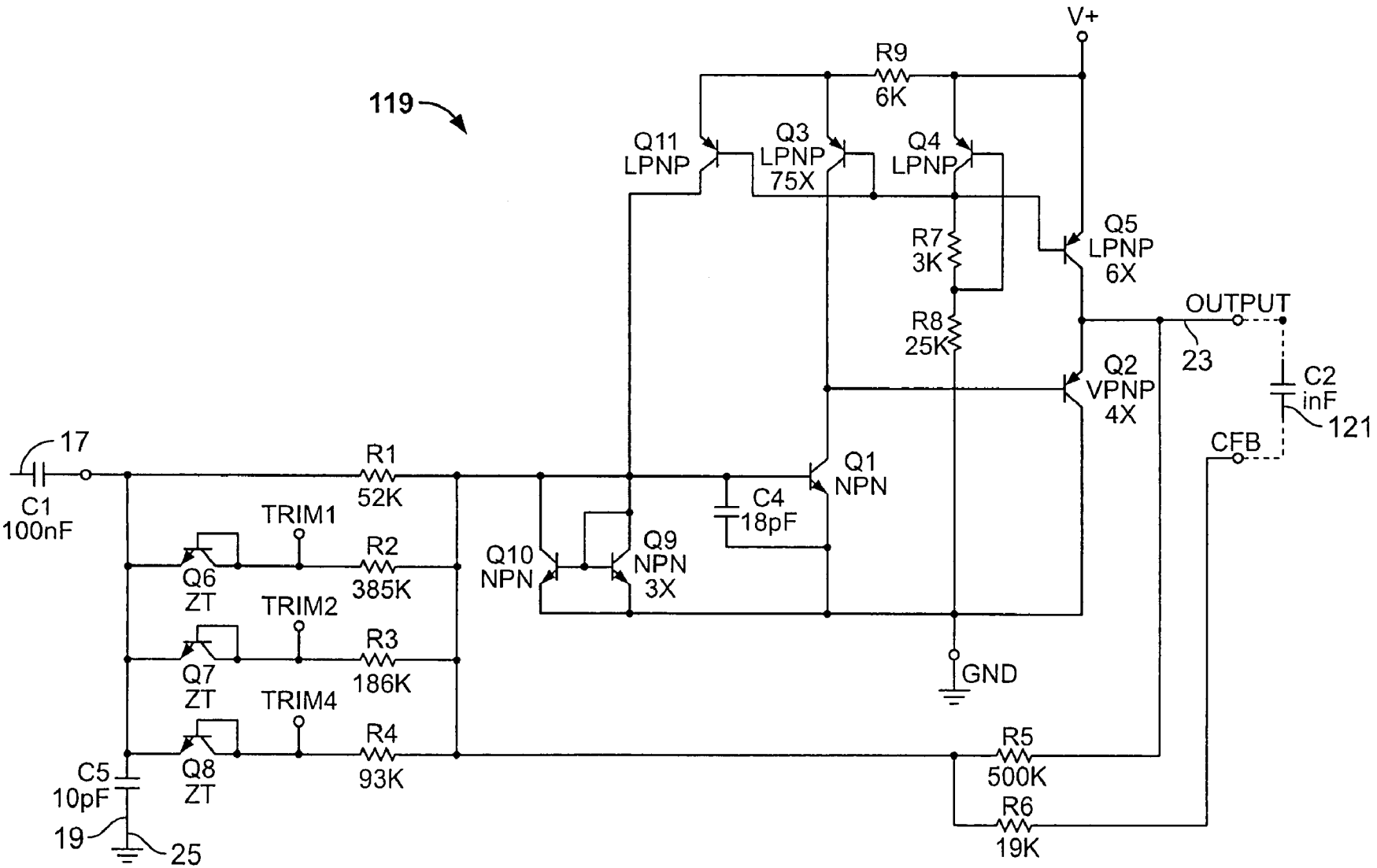
FIG. 5 illustrates one embodiment of a microphone equalization circuit of the present invention.

FIG. 5 illustrates one embodiment of the microphone equalization circuit of the present invention. Inputs 17 and 19 and outputs 23 and 25 of circuit 119 in FIG. 5 correspond to the inputs and outputs of the microphone equalization circuit 21 of FIG. 1. Circuit 119 may be an integrated circuit portion coupled to an external capacitor 121 that sets the shape of the low frequency equalization characteristic. Circuit 119 also includes a electronic zener trimmer portion that enables electronic adjustment of the amplification provided by the circuit.

Figure 6:
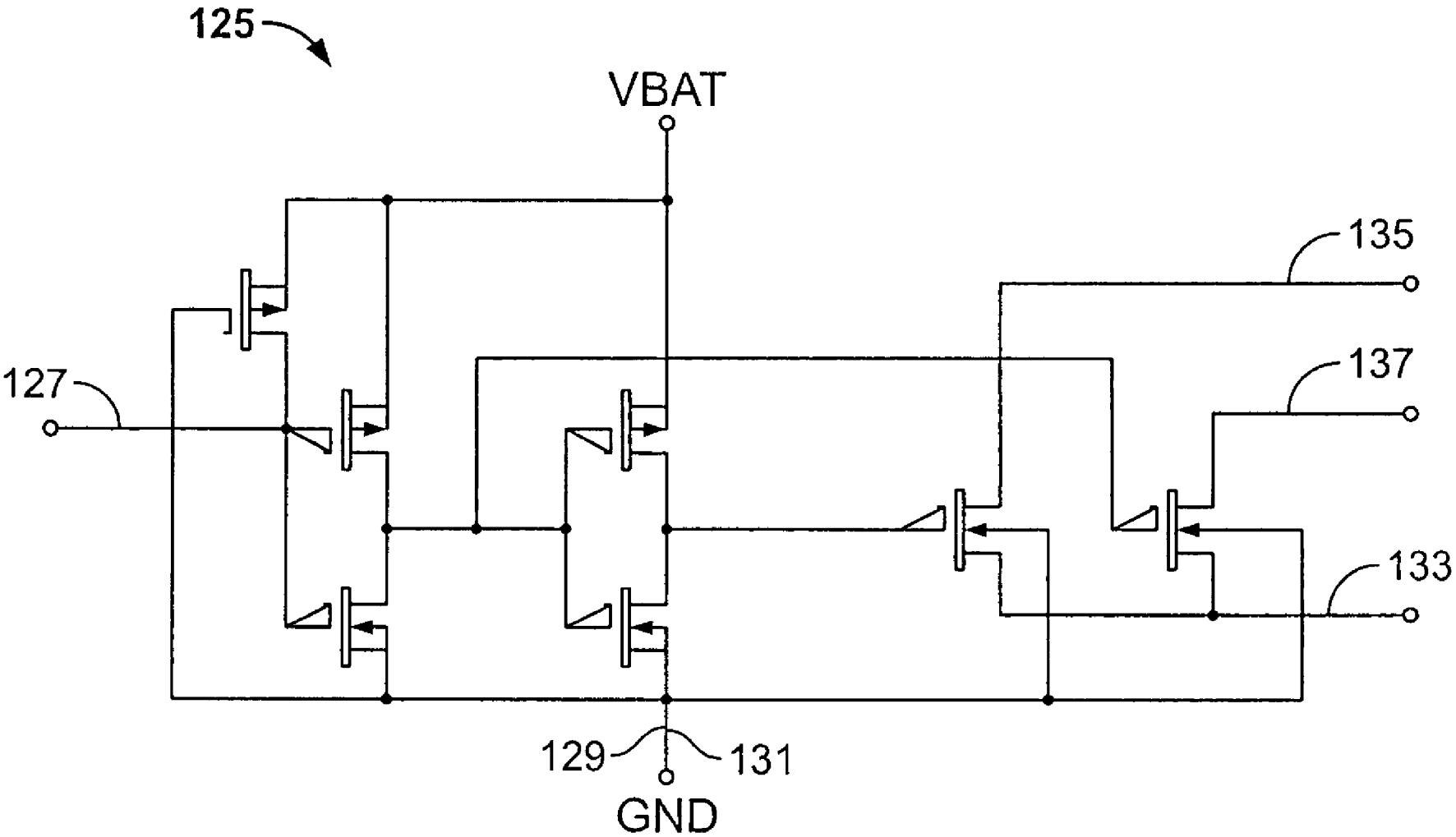
FIG. 6 illustrates one embodiment of an electronic contact sensor and switch of the present invention.

FIG. 6 illustrates one embodiment of the electronic contact sensor and switch of the present invention. Circuit 125 includes inputs 127 and 129 that are electrically connected to the conductors, such as conductors 14 and 16 of FIG. 1. Outputs 131 and 133 are electrically connected to an input circuit, such as, for example, a hearing aid amplifier, as discussed above. Outputs 131 and 133 of FIG. 6 correspond to outputs 29 and 31, respectively, of the electronic contact sensor and switch 27 of FIG. 1.

Circuit 125 further includes inputs 135 and 137 that correspond to inputs 23 and 17, respectively, of FIG. 1. For the embodiment of FIG. 1, when inputs 127 and 129 are electrically connected (i.e., conductors 14 and 16 are electrically connected together in the omni-directional mode), output 133 of circuit 125 is electrically connected to input 137 such that the output signal at output 133 is not equalized by circuit 119 of FIG. 5. When inputs 127 and 129 are not electrically connected (i.e., conductors 14 and 16 are not electrically connected in the directional mode), output 133 of circuit 125 is electrically connected to input 135 such that the output signal at output 133 is equalized by circuit 119 of FIG. 5. If, alternatively as discussed above, it is desired to have electrical coupling of conductors 14 and 16 produce the opposite switching results, the input signals connected to inputs 135 and 137 of circuit 125 of FIG. 6 would be reversed.

Circuit 125 of FIG. 6 may, for example, utilize n and p channel CMOS integrated circuit technology.

In view of the above-detailed description of the present invention and associated drawings, other modifications and variations will now become apparent to those skilled in the art. It should also be apparent that such other modifications and variations may be effected without departing from the spirit and scope of the present invention.

What is claimed and desired to be secured by Letters Patent is:

1. A microphone assembly comprising:

at least one inlet tube;

a microphone cartridge having at least one inlet port acoustically coupled to the at least one inlet tube;

an actuator switch being movable between a first position in which the at least one inlet tube is plugged and a second position in which the at least one inlet tube is unplugged; and circuitry for sensing whether the actuator switch is in the first position or the second position.

2. The microphone assembly of claim 1 wherein the circuitry comprises an electronic contact and sensor switch.

3. The microphone assembly of claim 2 wherein the electronic contact and sensor switch comprises first and second conductors.

4. The microphone assembly of claim 3 wherein the actuator switch has an electrical contact mounted therewith for providing electrical conduction between the first and second conductors when the actuator switch is in one of the first and second positions.

5. The microphone assembly of claim 1 wherein the circuitry selects an non-equalized output when the actuator switch is in the first position, and an equalized output when the actuator switch is in the second position.

6. The microphone assembly of claim 5 wherein the circuitry selects a non-equalized output when the actuator switch is in the first position in response to conduction between the first and second conductors provided by the electrical contact, and wherein the circuitry selects an equalized output when the actuator switch is in the second position in response to no conduction between the first and second conductors.

7. The microphone assembly of claim 1 wherein the circuitry selects an output having higher gain when the actuator switch is in first position, and an output having lower gain when the actuator switch is in the second position.

8. The microphone assembly of claim 1 wherein the circuitry selects an output having lower environmental noise reduction when the actuator switch is in the first position, and an output having higher environmental noise reduction when the actuator switch is in the second position.

9. The microphone assembly of claim 1 further comprising a housing, and wherein the circuitry is at least partially integral to the housing.

10. The microphone assembly of claim 1 wherein the circuitry is at least partially integral to the microphone cartridge.

11. The microphone assembly of claim 1 wherein the output selected is input to hearing aid circuitry.

12. A microphone assembly comprising:

a microphone cartridge;

a first inlet tube coupled to the microphone cartridge;

a second inlet tube coupled to the microphone cartridge;

an actuator switch being movable between a first position in which the second inlet tube is plugged and a second position in which the second inlet tube is unplugged; and circuitry for selecting a first output when the actuator switch is in the first position, and a second output when the actuator switch is in the second position.

13. The microphone assembly of claim 12 wherein the circuitry comprises an electronic contact and sensor switch having first and second conductors.

14. The microphone assembly of claim 13 wherein the actuator switch has an electrical contact mounted therewith for providing electrical conduction between the first and second conductors when the actuator switch is in one of the first and second positions.

15. The microphone assembly of claim 12 wherein the first output comprises a non-equalized output and the second output comprises an equalized output.

16. The microphone assembly of claim 14 wherein the first output comprises a non-equalized output and is selected in response to conduction between the first and second conductors provided by the electrical contact, and wherein the second output comprises an equalized output selected in response to no conduction between the first and second conductors.

17. The microphone assembly of claim 12 wherein the first output has a first gain value and the second output has a second gain value.

18. The microphone assembly of claim 12 wherein the first output has an first environmental noise reduction amount and the second output has a second environmental noise reduction amount.

19. The microphone assembly of claim 12 further comprising a housing, and wherein the circuitry is at least partially integral to the housing.

20. The microphone assembly of claim 12 wherein the circuitry is at least partially integral to the microphone cartridge.

21. The microphone assembly of claim 12 wherein the output selected is input to hearing aid circuitry.

* * * * *